United States Patent [19]

Rosen

[11] 4,424,162

[45] Jan. 3, 1984

[54] SELECTIVE HYDROGENATION OF FATTY MATERIALS

[75] Inventor: Bruce I. Rosen, Skokie, Ill.

[73] Assignee: UOP Inc., Des Plaines, Ill.

[21] Appl. No.: 297,883

[22] Filed: Aug. 31, 1981

[51] Int. Cl.[3] ..... C11C 3/12

[52] U.S. Cl. ..... 260/409

[58] Field of Search ..... 260/409

[56] References Cited

U.S. PATENT DOCUMENTS

| | | | |
|---|---|---|---|
| 3,198,816 | 8/1965 | Zajceu | 260/409 |
| 3,271,410 | 9/1966 | Cagneron et al. | 260/409 |
| 3,407,227 | 10/1968 | Beck et al. | 260/409 |
| 3,787,459 | 1/1974 | Frankel | 260/409 X |
| 3,824,262 | 7/1974 | Heslinga et al. | 260/409 |
| 4,118,342 | 10/1978 | Debus et al. | 260/409 X |
| 4,161,483 | 7/1979 | Cahen | 260/409 |
| 4,228,088 | 10/1980 | Kuiper | 260/409 |
| 4,307,026 | 12/1981 | Kuiper | 260/409 |

OTHER PUBLICATIONS

C. H. Riesz and H. S. Weber, *J. Am. Oil Chem. Soc.,* 41, 400(1964).

*Primary Examiner*—Helen M. S. Sneed
*Attorney, Agent, or Firm*—James R. Hoatson, Jr.; Eugene I. Snyder; William H. Page, II

[57] ABSTRACT

Hydrogenation of fatty materials using zerovalent platinum group metals supported on alpha-alumina are substantially more selective than those where the metal is supported on a porous alumina. An alpha-alumina with surface area less than about 5 $m^2/g$, a micropore volume under about 0.05 ml/g, and a macropore volume less than about 0.25 ml/g is particularly desirable. Using these methods, continuous hydrogenations based on a fixed bed process are sufficiently selective to be commercially practicable.

10 Claims, No Drawings

SELECTIVE HYDROGENATION OF FATTY MATERIALS

BACKGROUND OF THE INVENTION

Although some edible oils are used per se, by far the largest portion are hydrogenated, or hardened, prior to their end use. The reason for such hydrogenation is to increase the stability of the final product. For example, processed soybean oil is susceptible to oxidation resulting in deterioration of its organoleptic properties even upon storage at ambient temperature. Where the oil is to be used at higher temperatures, for example, as a frying oil, the adverse organoleptic consequences of oxidation become even more pronounced.

The commonly accepted origin of oxidative deterioration is the presence of highly unsaturated components, such as the triene moiety, linolenate, in soybean oil. Partial hydrogenation to remove most of this component leads to a marked increase in the oxidative stability of the resulting product, thereby facilitating storage and permitting unobjectionable use at higher temperatures. Ideally, one desires this hydrogenation to be highly specific, reducing only triene to the diene, linoleate, without effecting cis to trans isomerization. In practice, this goal is unachievable.

The fatty materials which are the subject of this invention are edible oils and fats which are triglycerides of fatty acids, some of the acids being saturated and others being unsaturated. In vegetable oils, the major saturated fatty acids are lauric (12:0), myristic (14:0), palmitic (16:0), stearic (18:0), arachidic (20:0), and behenic (22:0) acids. The notation, "18:0", for example, means an unbranched fatty acid containing 18 carbon atoms and 0 double bonds. The major unsaturated fatty acids of vegetable oils may be classified as monounsaturated, chief of which are oleic (18:1) and erucic (22:1) acids, and polyunsaturated, chief of which are the diene linoleic acid (18:2), and the triene linolenic acid (18:3). Unhardened vegetable fats and oils contain virtually exclusively cis-unsaturated acids.

In the context of partial hydrogenation, the ultimate goal is the reduction of triene to diene without attendant trans acid formation or saturate formation. In practice, it is observed that partial reduction results in lowering both triene and diene and increasing the monoene, saturate, and trans levels. Because it is desired that the product of partial hydrogenation itself be a liquid oil relatively free of sediment or even cloudiness upon storage at, for example, 10° C., the formation of saturated and trans acids in such hydrogenation is a vexing problem. Removal of these solids, whose relative amount is measured by the Solid Fat Index (SFI), is a relatively costly and inefficient process attended by large losses associated with the separation of gelatinous solids from a viscous liquid. It is known in the art that such solids are composed largely of triglycerides containing at least one saturated fatty acid moiety and/or trans monounsaturated fatty acid moieties with the predominant culprits having at least 18 carbon atoms. It is further known in the art that fatty acid analysis alone is an insensitive analytical tool, that is to say, two products of hydrogenation of, for example, soybean oil may be vastly different in their SFI while having virtually identical fatty acid analysis. This arises because the distribution of the saturated moieties in the triglyceride is important. The solubility in the soybean oil of disaturated triglycerides is much less than twice the amount of monosaturated triglycerides, and the solubility of monosaturated triglycerides may depend upon whether the other fatty acid moieties of the triglyceride are monounsaturated, diunsaturated, etc., and may also depend upon whether the saturated portion is at the one-or two-position of the triglyceride. Hence, hydrogenation of edible fats and oils is largely an empirical process, whose analytical tools include SFI supported by fatty acid analysis. The difficulty of achieving desirable results, in the context of selectivity in hydrogenation as manifested by the Solid Fat Index, has limited such hydrogenation largely to a batch type process. Although the transition from a batch to a continuous process, especially of the fixed bed type, is conceptually facile, it will be recognized by the skilled worker that impediments have been substantial.

Although nickel has been the standard hydrogenation catalyst in the vegetable oil industry for some time, it has been recognized that platinum group metals have many desirable properties when employed in a similar use. C. H. Riesz and H. S. Weber, *J. Am. Oil Chem. Soc.*, 41, 400 (1964). However, for these metals to be an acceptable hydrogenation catalyst for fatty materials it is necessary that their selectivity be substantially improved over prior art catalysts based on the platinum group metals.

An object of this invention is to provide a method of hydrogenating fatty materials using platinum group metals as a hydrogenation catalyst, wherein the selectivity of the hydrogenation is substantially improved compared to prior art methods based on these metals. An embodiment comprises contacting the fatty material with a zerovalent metal selected from the group consisting of platinum, ruthenium, palladium, iridium, and osmium, supported on alpha-alumina having a surface area of less than about 15 $m^2/g$ in the presence of hydrogen under hydrogenation conditions. In a more specific embodiment the fatty material is soybean oil. In a still more specific embodiment the zerovalent metal is platinum.

An advantage of the method described herein is that it uses commonly available materials as the catalyst in the process of this invention. Another advantage is that it is applicable both to light hydrogenation, that is, one where the iodine value decreases by about 10 to about 30 units, and to deeper hydrogenation, where the iodine value decreases by about 30 to about 70 units.

Still another advantage is that the selectivity of the method described herein is substantially better than prior art methods both in batch and continuous processes. Yet another advantage attributable to the method herein is its applicability to a wide variety of edible oils and fats.

DESCRIPTION OF THE INVENTION

The invention described herein relates to a method of selective hydrogenation of a fatty material selected from the group consisting of edible oils and fats comprising contacting the fatty material with a catalytically effective amount of a zerovalent metal selected from the group consisting of platinum, ruthenium, palladium, rhodium, iridium, and osmium, supported on alpha-alumina whose surface area is less than about 15 $m^2/g$ with a macropore volume less than about 0.5 ml/g in the presence of hydrogen under hydrogenation conditions, and recovering the resulting hydrogenated product. This invention is based on the discovery, previously unknown and without precedent, that when zerovalent platinum group metals are supported on alpha-alumina of low surface area and low macropore volume, the selectivity of the resulting supported material as a catalyst in hydrogenation of fatty materials substantially increases relative to the same material supported on more conventional material, such as gamma-alumina. This observation contrasts with the prior art emphasis upon using porous supports for platinum group metals as a hydrogenation catalyst.

One index of selectivity as used herein is the Solid Fat Index, as described above. Another index of selectivity relied upon here and commonly used elsewhere can be better understood from the following partial reaction sequence, where k is the rate constant for the indicated hydrogenation step.

$$18{:}3 \xrightarrow{k_3} 18{:}2$$

$$18{:}2 \xrightarrow{k_2} 18{:}1$$

$$18{:}1 \xrightarrow{k_1} 18{:}0$$

$$^{S}LN = k_3/k_2$$

$$^{S}LO = k_2/k_1$$

$^{S}$LN is termed the linolenate selectivity; a high value is characterized by relatively high yields of dienoic acid in the reduction of an unsaturated triglyceride containing trienoic acids. $^{S}$LO is the linoleate selectivity; a high value is characterized by relatively high yields of monoenoic acid in a reduction of an unsaturated triglyceride containing dienoic acids. An oil such as soybean oil contains both trienoic and dienoic acids, thus $^{S}$LN and $^{S}$LO may be measured simultaneously.

The catalyst used in the process of this invention affords hydrogenated products with substantially improved SFI profiles and shows substantially increased values of $^{S}$LN and $^{S}$LO relative to the platinum group metal catalysts of the prior art.

The method described herein is generally applicable to edible oils and fats. Because the partial hydrogenation of liquid oils to afford hardened, but still liquid, oils occupies a prominent part within the domain of hydrogenation of edible oils and fats, the method of this invention is particularly applicable to such partial hydrogenation. Thus, the described method of hydrogenation is especially useful to partially harden edible liquid oils whereby the iodine value (IV) is lowered by about 10 to about 30 units by hydrogenation, whereby the increase in saturates attending hydrogenation is less than about 1.5% and the triene level is reduced to at least 3%. The term "iodine value" is a measure of the total extent of unsaturation in an edible oil or fat as performed by a standard test. In the context of soybean oil, which is a particularly important liquid vegetable oil, partial hardening is continued to an IV drop of from about 15 to about 25 units, with the product having less than about 6% stearate and less than about 3% linolenate.

The method of this invention is especially applicable to liquid vegetable oils. Examples of such oils include soybean oil, cottonseed oil, sunflower oil, safflower oil, rapeseed oil, and liquid fractions from palm oil. The application of this method to soybean oil is especially important. As will be recognized by those skilled in the art, partial hydrogenation of liquid oils to afford partially hardened liquid oils is especially demanding, hence it is to be expected that a method suitable for this task also is suitable for more extensive hydrogenation. Thus, the method described herein also is suitable for more extensive hydrogenation, where the change in IV is from about 30 to about 70 units. Oils and fats which can be so hydrogenated include those above, their partially hydrogenated products, and also such feedstocks as palm oil.

The hydrogenation catalyst used in this method is essentially a catalytically active zerovalent platinum group metal deposited on alpha-alumina. Although such platinum group metals are broadly known in this art area, they are generally used on supports such as kieselguhr and alumina of high surface area and large porosity. A discovery which distinguishes this invention from the prior art is that such metals on supports characterized by low surface area and low porosity effect hydrogenation of fatty materials with substantially better selectivity than do these metals on the supports of the prior art methods. The metals which may be used include platinum, palladium, ruthenium, rhodium, iridium, and osmium. Among these platinum, palladium, and ruthenium are preferred, with platinum being an especially desirable metal.

The hydrogenation catalyst of this method consists essentially of a catalytically active zerovalent metal from the aforementioned group supported on alpha-alumina with a surface area less than about 15 $m^2$ per gram, a surface area less than 5 $m^2$ per gram being preferred. Additionally, the micropore volume of the support must be less than about 0.05 ml/g, with a macropore volume less than about 0.5 ml/g, and with greater than about 90% of the macropores having a size greater than about 300 angstroms. Within this range, it is preferred that the alpha-alumina have a macropore volume less than about 0.25 ml/g, with more than about 95% of the macropores larger than about 1000 angstroms, and more preferably larger than about 3500 angstroms. By micropore volume is meant the total volume of pores under about 117 angstroms in size; by macropore volume is meant the total volume of pores greater than about 117 angstroms in size. It will be recognized that such a catalyst represents a radical departure from those of the prior art, and it is to be emphasized that such a departure is a prerequisite for increasing the selectivity of hydrogenation using the metals of the instant process.

The concentration of the zerovalent metal on the support is not critical, although generally it is less than 10% by weight. In the more usual case, the metal is present at a concentration from about 0.1 to about 5% by weight of the support.

The catalytically effective amount of zerovalent metal depends on the nature of the metal, the degree of selectivity desired, the hydrogenation conditions employed, and the degree of hydrogenation, inter alia. For example, when platinum or palladium is the metal concentrations from about 0.0001 to about 0.1% by weight of fatty material may be used, with concentrations in the range from about 0.001 to about 0.05% being preferred. Where ruthenium and rhodium are used, concentrations may be from about 0.0001 to about 0.1% by weight of fatty material, with the preferred range being from about 0.001 to about 0.1%.

Hydrogenation is carried out at a temperature from about 100° to about 250° C., the range of about 125° to about 225° being somewhat preferred. Hydrogenation may be conducted at a pressure from about atmospheric up to about 150 psig. The lower pressure range is favored, with pressures from about 5 to about 50 psig being preferred.

Hydrogenation performed in accord with this invention may be carried out in a batch process. In this mode, the fatty material and a suitable amount of catalyst will be mixed in a reactor. Generally, air will be removed and the temperature of the mixture brought up to the desired point, between 100° and 250° C. When the reaction temperature has been achieved, hydrogen will be admitted to a pressure up to about 150 psig and maintained at the desired pressure. The reactant mixture is vigorously stirred so as to make effective contact with hydrogen. The course of hydrogenation may be monitored by suitable means, such as iodine value, and the hydrogenation is continued for a time sufficient to achieve the desired degree of hydrogenation. This time will depend on reaction conditions as well as feedstock, but for soybean oil whose iodine value is being lowered from about 10 to about 30 units the time may range from about 0.5 to about 8 hours. Thereafter the reaction mixture is removed from its vessel, the catalyst is separated by suitable means, for example filtration, and the resulting hydrogenated fatty material is recovered.

The following description is applicable to a fixed bed operation, although it will be recognized that by suitable changes it may also be applicable to expanded or fluidized bed operation. The catalyst bed may be in the form of pellets, granules, spheres, extrudate, and so forth. The reactor is heated to the desired reaction temperature, from about 100° to about 250° C., in a hydrogen atmosphere at a pressure from about atmospheric up to about 150 psig, often with a small hydrogen flow. After attainment of the desired temperature, the feedstock of edible fats and oils is made to flow over the fixed bed. The flow may be either downflow, as in a trickle bed operation, or upflow, as in a flooded bed operation. The flow rate of the oil may be from about 0.5 to about 20 LHSV. When the flow of edible fats and oils is initiated, it is desirable to mix the hydrogen with said fats and oils so as to maintain the desired pressure. Often it is advantageous to admit excess hydrogen, maintaining pressure by partial venting. As the reaction proceeds and the activity of the catalyst bed decreases, adjustments may be made either in the LHSV or the temperature to maintain the desired characteristics of the product. Partially hardened oil is recovered as the effluent in a state suitable for further processing, such as blending, bleaching, or deodorization.

The examples herein are cited for illustrative purposes only and are not to be construed as limiting this invention in any way.

EXAMPLE 1

Hydrogenation catalysts generally were prepared by impregnating the support with a suitable inorganic salt of the metal, calcining the impregnated support with air at elevated temperatures, and finally reducing the impregnated metal salt with hydrogen at elevated temperatures. Catalyst A is 0.1% platinum on gamma-alumina (1/16 inch pellets, 200 $m^2/g$ surface area, micropore volume 0.5 ml/g, macropore volume 0.3 ml/g) which was prepared by impregnating the alumina with chloroplatinic acid, followed by calcination in air at 450° C. for 3 hours, and then reducing the resulting material with hydrogen at 450° C. for 2 hours. Catalyst B is 0.1% platinum on alpha-alumina (1/16 inch pellets, surface area 3 $m^2/g$, micropore volume less than 0.03 ml/g, macropore volume 0.2 ml/g) which was prepared by impregnating the alumina with chloroplatinic acid, calcining the resulting material in air at 500° C. for 2 hours, followed by reduction in a hydrogen atmosphere at 500° for 3 hours. Catalyst C is a 1% ruthenium on gamma-alumina (1/16 inch pellets, 200 $m^2/g$ surface area, micropore volume 0.5 ml/g, macropore volume 0.3 ml/g) which was prepared by impregnating the alumina with an aqueous solution of $RuCl_3.3H_2O$ calcining the resulting material in air at 450° for 2 hours, followed by reduction in hydrogen at 450° C. for 3 hours. Catalyst D is 1% ruthenium on alpha-alumina prepared by impregnating the alumina with an aqueous solution of $RuCl_3.3H_2O$, calcining the resulting material in air at 450° C. for 2 hours, followed by reduction in hydrogen at 450° C. for 3 hours.

SUMMARY OF CATALYSTS

| Designation | Description |
|---|---|
| A | 0.1% Pt on gamma-alumina[a], 1/16" pellets |
| B | 0.1% Pt on alpha-alumina[b], 1/16" pellets |
| C | 1% Ru on gamma-alumina[a], 1/16" pellets |
| D | 1% Ru on alpha-alumina[b], 1/16" pellets |

[a]The gamma-alumina had the following properties: surface area, 200 $m^2/g$; micropore[c] volume, 0.5 ml/g; macropore[c] volume, 0.3 ml/g.

[b]The alpha-alumina had the following properties: surface area, 3 $m^2/g$; micropore volume less than 0.03 ml/g; macropore volume 0.2 ml/g. The support had the following macropore volume characteristics (in ml/g): 117–500 angstroms, 0.0000; 500–1000 angstroms, 0.0003; 1000–3500 angstroms, 0.0000; 3500–17,500 angstroms, 0.2037; 17,500–58,333 angstroms, 0.0000.

[c]Micropore volume is the total volume of pores under about 117 angstroms in size; macropore volume is the total volume of pores greater than about 117 angstroms in size, as determined by ANSI/ASTM D 2873-10.

EXAMPLE 2

Batch hydrogenations were carried out in a 350 ml stirred autoclave. Before introduction of hydrogen, the reactor with catalyst and feed present was flushed for several minutes with nitrogen. Hydrogen was then introduced and maintained at the desired pressure.

Batch Reduction of Soybean Oil

| Catalyst | T °C. | Psig | IV | 18:3 | 18:2 | 18:1 | 18:0 | 16:0 |
|---|---|---|---|---|---|---|---|---|
| None | | | 134 | 7.7 | 54.6 | 23.3 | 4.2 | 10.2 |
| D(0.08% Ru) | 190 | 45 | 95 | 0.3 | 29.8 | 49.7 | 9.5 | 10.6 |

EXAMPLES 3–12

Hydrogenations were conducted in a reactor of conventional design containing a fixed bed of 15 to about 70 ml catalyst. The reactor had a preheater section for bringing feedstock to temperature and a heater for the reaction zone. The feedstock, which was soybean oil in these samples, was passed upflow by a metering pump and mixed with hydrogen before the preheater stage. In all cases there was a net excess of hydrogen, that is, hydrogen in excess of that necessary for reaction was introduced into the reaction zone and excess hydrogen was vented so as to maintain a constant pressure.

Iodine values were determined by AOCS method CD1-25 or were calculated from the measured fatty acid distribution. Solid fat index was determined by AOCS method CD10-57. Fatty acid distribution was determined by AOCS method CE2-66.

TABLE 1

CONTINUOUS HYDROGENATION OF SOYBEAN OIL

| Catalyst | T, °C. (furnace) | Pressure psig | WHSV | Iodine Value (calc) | % Composition 18:3 | 18:2 | 18:1 | 18:0 | 16:0 | $S_{Ln}$ | $S_{Lo}$ |
|---|---|---|---|---|---|---|---|---|---|---|---|
| A | 210 | 50 | 7.2 | 113.1 | 3.2 | 40.6 | 39.9 | 5.5 | 10.7 | | |
| | 193 | 50 | 5.4 | 110.0 | 2.8 | 38.2 | 42.5 | 5.8 | 10.7 | 2.2 | 8.9 |
| B | 201 | 50 | 1.1 | 96.0 | 0.4 | 28.2 | 53.8 | 6.9 | 10.7 | 3.6 | 11.7 |
| | 200 | 30 | 1.1 | 107.6 | 1.7 | 38.0 | 44.2 | 5.7 | 10.8 | 3.1 | 10.1 |
| C | 215 | 50 | 4.0 | 118.6 | 5.4 | 42.2 | 36.5 | 5.9 | 10.0 | 1.2 | 5.3 |
| | 231 | 30 | 3.0 | 118.2 | 4.2 | 43.9 | 36.4 | 5.3 | 10.2 | 2.0 | 7.3 |
| D | 190 | 30 | 1.8 | 122.3 | 3.6 | 50.0 | 30.5 | 5.0 | 10.8 | 4.8 | 4.0 |
| | 192 | 30 | 1.3 | 118.8 | 2.6 | 48.5 | 32.8 | 5.3 | 10.9 | 5.2 | 4.1 |
| | 225 | 30 | 1.0 | 105.6 | 0.6 | 38.3 | 43.7 | 6.2 | 11.2 | 5.2 | 6.4 |
| | 203 | 50 | 1.3 | 113.5 | 2.3 | 43.6 | 37.4 | 5.8 | 11.0 | 3.7 | 5.0 |

TABLE 2

SOLID-FAT INDEX OF PARTIALLY HARDENED SOYBEAN OILS

| Catalyst | A | B | C | D |
|---|---|---|---|---|
| IV (calc) | 110 | 108 | 118 | 106 |
| SFI | | | | |
| 50° F. | 8.1 | 5.7 | 3.7 | 7.7 |
| 70° F. | 3.0 | 1.5 | 1.1 | 2.1 |
| 80° F. | 1.2 | 0.2 | .1 | 0.4 |
| 92° F. | 0.1 | 0 | 0 | 0 |
| 104° F. | 0 | 0 | 0 | 0 |
| $S_{Ln}$ | 2.2 | 3.1 | 2.0 | 5.2 |
| $S_{Lo}$ | 8.9 | 10.1 | 7.3 | 6.4 |

What is claimed is:

1. A method of selective hydrogenation of a fatty material selected from the group consisting of edible oils and fats comprising contacting said fatty material with a catalytically effective amount of a zerovalent metal selected from the group consisting of platinum, ruthenium, palladium, rhodium, iridium, and osmium, supported on alpha-alumina, whose surface area is less than about 15 $m^2/g$ with a macropore volume less than about 0.5 ml/g and with greater than about 90 percent of the macropores having a size greater than about 300 angstroms and micropore volume less than about 0.05 ml/g, in the presence of hydrogen under hydrogenation conditions, and recovering the resulting hydrogenated product.

2. The method of claim 1 wherein said fatty material is a liquid vegetable oil.

3. The method of claim 2 wherein said liquid vegetable oil is selected from the group consisting of soybean oil, cottonseed oil, rapeseed oil, sunflower oil, safflower oil, and liquid fractions from palm oil.

4. The method of claim 2 wherein said oil is soybean oil and contacting is of a duration sufficient to lower the iodine value by about 10 to about 30 units.

5. The method of claim 1 wherein the metal is platinum or palladium.

6. The method of claim 1 wherein the metal is ruthenium.

7. The method of claim 1 where the surface area is less than 5 $m^2/g$.

8. The method of claim 7 wherein the alpha-alumina is further characterized by a micropore volume of less than about 0.05 ml/g.

9. The method of claim 1 where the macropore volume is less than about 0.25 ml/g.

10. The method of claim 1 where the hydrogenation conditions are characterized by a temperature from about 100° to about 250° C. and a hydrogen pressure from about atmospheric to about 150 psig.

* * * * *